United States Patent [19]

Ando et al.

[11] 4,147,494

[45] Apr. 3, 1979

[54] GAS BURNER IGNITION DEVICE

[75] Inventors: Tsuneo Ando; Hironori Nakajima, both of Konan, Japan

[73] Assignee: Howa Sangyo Kabushiki Kaisha, Aichi, Japan

[21] Appl. No.: 733,741

[22] Filed: Oct. 19, 1976

[30] Foreign Application Priority Data

Apr. 14, 1976 [JP] Japan ..... 51-42974
Apr. 14, 1976 [JP] Japan ..... 51-42975

[51] Int. Cl.[2] ..... F23H 5/08
[52] U.S. Cl. ..... 431/71; 62/148; 431/80; 431/266
[58] Field of Search ..... 431/71, 78, 80, 65, 431/66, 266; 62/148; 340/228 R

[56] References Cited

U.S. PATENT DOCUMENTS

| | | | |
|---|---|---|---|
| 3,701,137 | 10/1972 | Hulsman | 431/80 X |
| 3,726,630 | 4/1973 | Potts | 431/78 |
| 3,893,306 | 7/1975 | Kroll et al. | 62/148 |
| 3,920,375 | 11/1975 | Sanderson et al. | 431/78 |
| 3,938,937 | 2/1976 | Matthews | 431/78 |
| 4,025,284 | 5/1977 | Horn et al. | 431/80 |
| 4,032,286 | 6/1977 | Kobayashi et al. | 431/80 X |

*Primary Examiner*—Edward G. Favors
*Attorney, Agent, or Firm*—Ladas, Parry, Von Gehr, Goldsmith & Deschamps

[57] ABSTRACT

In a gas burner ignition device for a gas-operated refrigerator, the ignition electrode of a high voltage generating unit and the flame detecting rod of a flame detector are formed into one unit to miniaturize the device. The device comprises timer means which when the flame detector or the high voltage generating unit is out of order, operates to suspend the supply of gas to the gas burner.

2 Claims, 4 Drawing Figures

GAS BURNER IGNITION DEVICE

BACKGROUND OF THE INVENTION

This invention relates to gas burner ignition devices for gas-operated refrigerators, and more particularly to gas burner ignition devices most applicable to gas-operated refrigerators in vehicles or ships.

A gas-burner ignition device comprising in combination a flame detector utilizing conductivity due to the thermal effect of a flame, and an ignition unit or igniting the gas burner has been employed. On the other hand, a gas-operated refrigerator is operated by a relatively small gas flame because of its operating requirement. Therefore, the flame of the gas-operated refrigerator is liable to be unintentionally extinguished, for instance, by vibrations applied thereto or by air blowing thereinto.

In order to overcome this difficulty, the conventional gas-operated refrigerator has a flame detector to ignite the gas burner again. However, the conventional gas-operated refrigerator, cannot stop the supplying of gas to the gas burner immediately when the flame detector is out of order. Furthermore, the conventional gas burner ignition device has a disadvantage that the flame detecting electrode of the flame detector and the ignition electrode of the ignition unit are separately provided, and therefore it is difficult to miniaturize the gas burner ignition device.

SUMMARY OF THE INVENTION

Accordingly, an object of this invention is to provide a small gas burner device for a gas-operated refrigerator in which the flame detecting rod of a flame detector and the ignition electrode of a high voltage generating unit are formed into one unit.

Another object of the invention is to provide a gas burner ignition device for a gas-operated refrigerator in which failures of the flame detector and the high voltage generating unit are automatically detected to suspend the supply of gas to the gas burner.

The foregoing objects and other objects of this invention have been achieved by the provision of a gas burner ignition device for a gas-operated refrigerator which comprise gas flow control means provided in a gas line connected to a gas burner for controlling a flow rate of gas flowing to the gas burner, ignition control means for controlling ignition of the gas burner, the ignition control means having high voltage means with an ignition electrode for generating a high voltage to ignite gas supplied to the gas burner, and flame detecting means with a flame detecting rod for detecting both ignition and extinguishment of the gas to control the high voltage generating means in such a manner that upon ignition the high voltage generating means is deenergized, and upon extinguishment the high voltage generating means is energized again, the ignition electrode and the flame detecting rod being in the form of one unit, and which further comprises timer means which when the flame detecting means is out of order, operates to deenergize the high voltage generating means.

The nature, utility and principle of this invention will be more clearly understood from the following detailed description and the appended claims when read in conjunction with the accompanying drawings, in which like parts are designated by like reference characters.

DETAILED DESCRIPTION OF THE INVENTION

Figure 1:
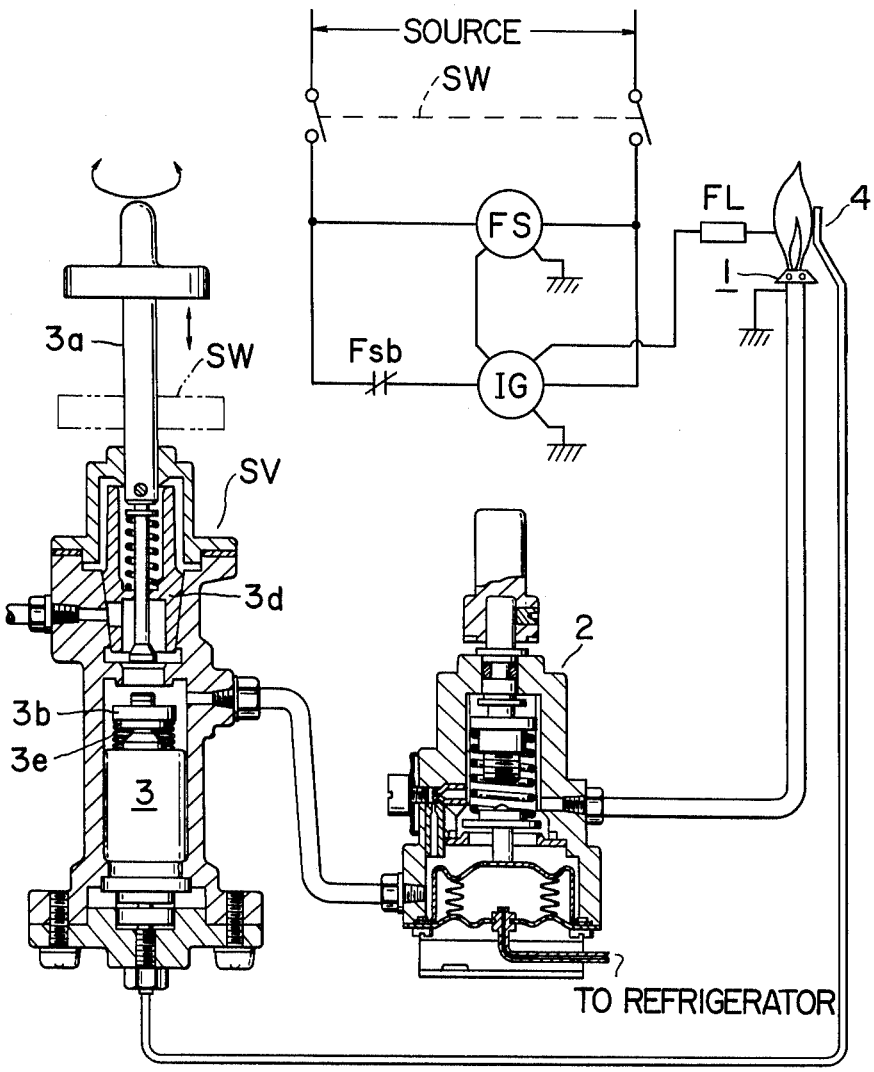
FIGS. 1 and 2 are explanatory diagrams respectively showing first and second examples of a gas burner ignition device according to the invention.

A first example of the invention, as shown in FIG. 1 comprises an ignition control means, or an electric circuit, described later, which is connected through a switch SW to an electrical source.

The electrical circuit comprises a high voltage generating unit IG, and a flame detector FS, the high voltage generating unit IG being connected to the electrical source through a normally closed contact means Fsb of the flame detector FS. An ignition electrode of the high voltage generating unit IG and a flame detecting rod of the flame detector FS are formed into one unit that is a flame rod FL.

The example further comprises a gas flow control means which in its gas flow path is provided with a safety valve SV having a thermocouple-operated electromagnetic attraction valve **3*b* which is normally held apart from an electromagnet 3 by the repulsive force of a spring 3*e* interposed therebetween, and also a control valve 2 for varying the flow rate of gas supplied to the gas burner 1 by sensing temperature in the refrigerator. The electromagnet 3 is activated by the electromotive force of a thermocouple 4 placed in the vicinity of the gas burner, to attract the attraction valve 3*b***.

The safety valve SV has a push-turn type valve control mechanism comprising an operating handle **3*a*. In order to open the safety valve SV, first the operating handle 3*a* is depressed to allow the attraction valve 3*b* to abut against the electromagent 3, and then the operating handle 3*a* is turned to turn a clock 3*d*** of the safety valve SV.

The switch SW is operated by turning the operating handle **3*a***.

The operation of the first example of the gas burner ignition device according to this invention will be described.

It is assumed that a main cock (not shown) in the gas flow path has been opened. If, under this condition, the attraction valve **3*b* is abutted against the electromagnet 3 by depressing the operating handle 3*a*, and this handle 3*a* is turned to open the safety valve, gas is supplied to the gas burner 1 and simultaneously the switch SW is closed by the turning of the operating handle 3*a***.

As a result, discharge is carried out by means of the flame rod FL operating as the electrode of the high voltage generating unit IG, so that the gas supplied to the gas burner 1 is ignited.

The flame of gas thus ignited is sensed by the thermocouple 4, which generates a thermal electromotive force to actuate the electromagnet 3. The electromagnet thus actuated attracts and holds the attraction valve **3*b*. Until this moment, the operating handle 3*a*** is maintained depressed.

Before the attraction valve 3b being attracted, the flame detector FS detects the flame to open its contact means Fsb, as a result of which the discharge of the high voltage generating unit is suspended.

If after ignition the flame is unintentionary extinguished by some reason, the extinguishment of the flame is immediately detected by the flame detector FS, and the contact means Fsb is closed again to operate the high voltage generating unit IG and thereby to ignite the gas again. In this operation, the safety valve SV is not immediately closed because the electromotive force induced by the thermocouple 4 decreases with a delay of time.

If the operating handle 3a of the safety valve SV is turned in the opposite direction, the supply of gas to the burner 1 is suspended, and simultaneously the switch SW is opened to deenergize the ignition control circuit.

This condition is sensed by the thermocouple 4, and the attractive valve 3b is released, and set back to its initial position by the repulsive force of the spring 30.

The size of the flame is automatically controlled by the control valve 2.

Figure 2:
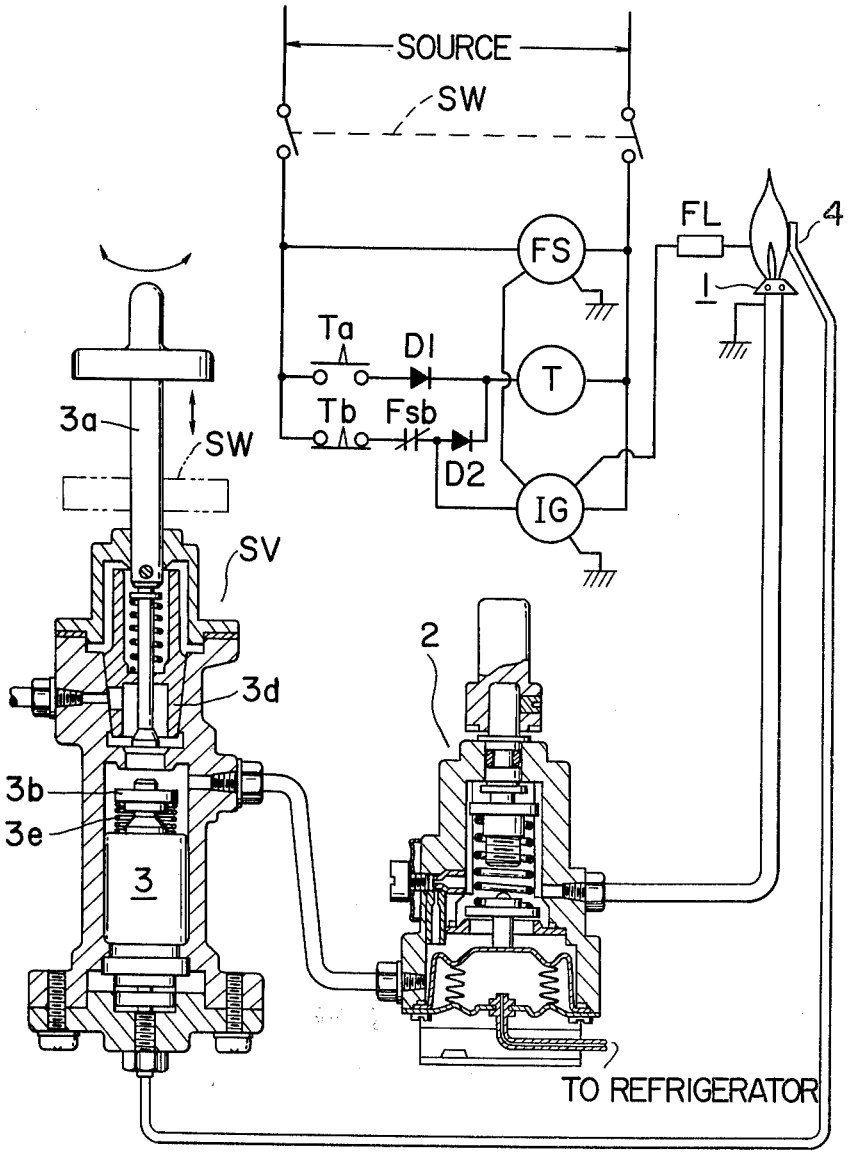

Shown in FIG. 2 is a second example of the gas burner ignition system according to this invention, which is obtained by adding a timer means to the first example (FIG. 1) as is apparent from the comparision between FIGS. 1 and 2.

More specifically, a series circuit of a timer T, a diode $D_1$, and a normally open contact means Ta is connected to the electrical source; and a series circuit of a normally closed contact means Tb of the timer T, the contact means Fsb of the flame detector FS, and a diode $D_2$ is connected in parallel to a series circuit of the contact means Ta and the diode $D_1$. The electrical source side terminal of the high voltage generating unit is connected to the connection point of the contact means Fsb and the diode $D_2$.

Similarly as in the first example, the operating handle 3a is depressed and turned to open the safety valve and to close the switch SW. Thereupon, the high voltage generating unit IG is energized through the contact means Tb and Fsb to cause the flame rod FL to start discharge, as a result of which the gas supplied through the opened safety valve to the gas burner 1 is ignited.

The flame of the gas thus ignited is sensed by the thermocouple 4, and the attraction valve 3b of the safety valve SV is attracted and held by the electromagnet 3 which has been energized by an electromotive force induced by the thermocouple 4, in the same manner as in the first example. At the same time, the flame detector FS detects the ignition to open its normally closed contact means Fsb, as a result of which the high voltage generating unit IG is deenergized to suspend its discharge while the operation of the timer T is also suspended.

If the gas burner's flame is unintentionally put out, the flame detector FS detects this extinguishment to close its contact means Fsb immediately, as a result of which the high voltage generating unit IG is energized through the contact means Tb and Fsb again to ignite the gas burner 1.

In the case when although the operation of the high voltage generating unit IG is normal and the flame has been ignited, the flame detector FS does not work, the timer T is energized through the contact means Tb and Fsb and the diode $D_2$. Therefore, in a predetermined period of time set by the timer T the normally open contact means Ta is closed to self-hold the timer T and simultaneously to open the normally closed contact means Tb to deenergize the high voltage generating unit IG, that is, to stop the discharge.

If thereafter this flame is extinguished unintentionally, the thermocouple 4 detects this extinguishment to operate the safety valve SV and thereby to stop the supply of gas to the gas burner 1.

The diodes $D_1$ and $D_2$ are to block a so-called "detour current" caused when a DC power source is employed.

The manual valve closing operation is carried out in the same manner as in the first example.

Figure 3:
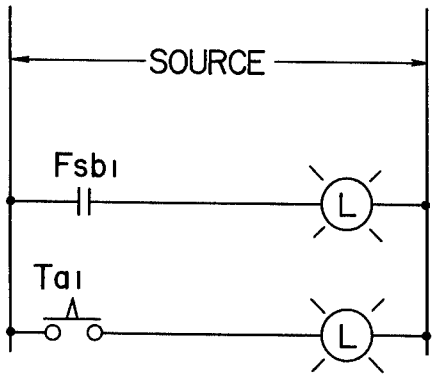
FIG. 3 is a schematic circuit diagram showing an ignition confirmation display unit and an alarm display unit.
Figure 4:
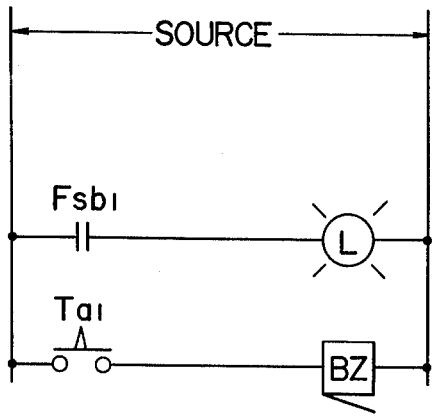
FIG. 4 is also a schematic circuit diagram showing an ignition confirmation display unit and a warning signal generating unit.

The second example may be provided with ignition confirmation display means and alarm indication means in which a normally open contact means $Fsb_1$ of the flame detector FS, an auxiliary contact means $Ta_1$ of the timer T, and lamps L are arranged as illustrated in FIG. 3. In FIG. 4, a buzzer BZ is used in place of the lamp L, to generate an alarm signal. Furthermore, this concept can be applied to control a defroster of the refrigerator.

As is apparent from the above description, the first and second examples are so designed that the flame reigniting mechanism and the safety valve cooperate with each other, to improve their security and reliability. The ignition unit and the flame detecting rod are formed into one unit according to the invention, which leads to the miniaturization of the gas burner ignition device. Furthermore, if a static piezolectric means instead of an electromagnetic high voltage generating means is employed as the high voltage generating unit IG, it is possible to form the flame detector and the ignition unit into one unit in the form of an integrated circuit. The maintenance of the gas burner ignition device can be readily performed because the troubles of the device can be readily detected.

What is claimed is:

1. A gas burner ignition device for a gas-operated refrigerator, which comprises:

(a) a safety valve provided in a gas line connected to a gas burner, for controlling a flow of gas supplied to said gas burner, said safety valve including a valve body having a first position in which it permits flow of gas to the gas burner and a second position in which it prevents such flow, and means biasing the valve body towards said second position;

(b) an electrode disposed adjacent the gas burner;

(c) ignition control means for controlling ignition of said gas burner, said ignition control means having high voltage generating means connected to said electrode and energizable to apply a high voltage to said electrode to ignite gas supplied to said gas burner, and flame detecting means connected to said electrode for detecting whether gas supplied to said gas burner is burning, said flame detecting means being connected to control said high voltage generating means so that when the gas is burning the high voltage generating means is de-energized whereas when the gas is extinguished the high voltage generating means is energized to re-ignite the gas;

(d) a thermocouple positioned adjacent the gas burner so as to be heated when gas supplied to the gas burner is burning, thereby to generate a thermal electromotive force; and (e) valve actuating means connected to the thermocouple and operable by the thermal electromotive force generated thereby when gas supplied to the gas burner is burning to overcome the biasing means and hold said valve body in its first position, the valve body being released and returning to the second position when the gas is extinguished.

2. A gas burner ignition device as claimed in claim 1, in which said ignition control means further comprises timer means which in a predetermined period of time operates to deenergize said high voltage generating means and to self-hold itself.

* * * * *